US005779423A

United States Patent [19]

Bermingham

[11] Patent Number: 5,779,423

[45] Date of Patent: Jul. 14, 1998

[54] SOFT COVER BOOK AND METHOD OF MAKING SAME

[76] Inventor: John F. Bermingham, 6490 S. Hermitage Pl. E., Englewood, Colo. 80111

[21] Appl. No.: 689,934

[22] Filed: Aug. 15, 1996

Related U.S. Application Data

[63] Continuation-in-part of Ser. No. 424,113, Apr. 19, 1995, abandoned.

[51] Int. Cl.[6] ..... B42C 11/00

[52] U.S. Cl. ..... 412/4; 412/1; 412/5; 412/37; 281/21.1; 281/29

[58] Field of Search ..... 412/1, 4, 5, 37; 281/15.1, 21.1, 29, 36, 37, 40

[56] References Cited

U.S. PATENT DOCUMENTS

| | | | |
|---|---|---|---|
| 1,913,320 | 6/1933 | Woodward | 281/40 X |
| 3,137,874 | 6/1964 | Hildmann et al. | 281/36 X |
| 3,437,506 | 4/1969 | Falberg . | |
| 4,187,571 | 2/1980 | Astero . | |
| 4,299,410 | 11/1981 | Jukola | 281/21 |
| 4,911,475 | 3/1990 | Lerman | 281/40 X |
| 5,156,510 | 10/1992 | Uehara | 281/21.1 X |

FOREIGN PATENT DOCUMENTS

| | | | |
|---|---|---|---|
| 2331852 | 6/1977 | France | 281/36 |
| 477987 | 6/1969 | Germany . | |

*Primary Examiner*—Frances Han
*Attorney, Agent, or Firm*—John E. Reilly

[57] ABSTRACT

A soft cover, lay flat book in which a non-adherent, unreinforced coating of a volatile liquid carrier and powdered material is disposed over the glue along the backbone of the book block prior to the assembly of the cover, and the cover is adhered or otherwise secured to the book block only between the front and rear leaves and outer surface portions of the book block so that the backbone is movable independently of the spinal cover when the book is opened and closed.

Alternately, the coating may be applied to the spinal portion of the cover and a laminate film affixed over the inner surface of the cover, again allowing independent movement of the backbone.

29 Claims, 2 Drawing Sheets

SOFT COVER BOOK AND METHOD OF MAKING SAME

CROSS REFERENCE TO RELATED APPLICATIONS

This application is a continuation-in-part application of Ser. No. 424,113, filed 19 Apr., 1995 now abandoned for SOFT COVER BOOK AND METHOD OF MAKING SAME, by John F. Bermingham.

BACKGROUND AND FIELD OF INVENTION

This invention relates to books and bindings therefor; and more particularly relates to a novel and improved soft cover, lay-flat book and to a method of manufacturing same in a reliable and efficient manner.

It has been customary in the manufacture of soft cover books to glue the collated pages of the book block together along the spine or backbone and then to apply the cover directly to the spine so that the cover is firmly united to the book block along the spine. A particular problem with this method is that the finished book will not lay flat, for example, when opened and placed on a surface since the cover will tend to resist upward bending or flexing of the spine. In an effort to overcome this problem, as disclosed in U.S. Pat. No. 4,299,410 to E. Jukola, it has been proposed to position a firm supply layer along the spine so as to separate the spine of the cover from that of the block and to glue or otherwise adhere the cover to the block only along the outside or outer surface portions of the block adjacent to the spine. In this way, when the book is opened the spine of the block is free to separate or move away from the spinal portion of the cover and more readily lay flat.

There is nevertheless a continuing problem in establishing the necessary independent movement and flexibility between the spinal portions of the book block and cover in that the use of a separate support layer requires extra manufacturing steps, and the support layer will introduce additional thickness to the spinal portion which will not always afford the maximum flexibility desired for the book to lay flat when opened. In addition, often greater adherent strength than that provided by standard glue is required between a book block and its cover, for instance, when a book block is especially large or heavy, while still allowing the book to lay flat when opened.

SUMMARY OF THE INVENTION

It is therefore an object of the present invention to provide for a novel and improved soft cover book and method of binding same which is low in cost, simplified in manufacture and will enable the book to lay flat when opened.

It is another object of the present invention to maintain separation between the spinal portions of the cover and book block comprising the book in a novel and improved manner.

A further object of the present invention is to provide for a novel and improved paperback book in which separation is maintained between the spinal portions of the cover and the book block so that the book block is free to assume a flattened condition when opened and the cover remains firmly adhered to the sides of the book block.

It is yet another object of the present invention to provide superior adherent strength between a book block and its cover, while still allowing the book to assume a flattened shape when opened.

In accordance with the present invention, a soft cover book has been devised wherein a book block is comprised of collated pages including an adhesive applied to a backbone and outer surface of the first and last pages of the block adjacent to the backbone, a cover including front and rear leaves superimposed on the first and last pages of the book block and a spinal portion between the front and rear leaves in overlying relation to the backbone, the front and rear leaves being hinged to the spinal portion adjacent to the backbone, the improvement comprising a non-adherent coating disposed between the spinal portion of the cover and the backbone, the coating being composed of a quick-drying liquid carrier and a powdered material so that, when the carrier dries, a residue of the powdered material remains along said backbone whereby the backbone is movable independently of the spinal portion when the book is opened or closed. preferably, the non-adherent coating takes the form of alcohol and baking soda which will prevent the spinal portion of the cover from adhering to the backbone, and the adhesive takes the form of beads of glue just outwardly of or beyond the hinge means between the front and rear leaves and spinal portion of the cover.

In the method of manufacturing, a soft cover book in accordance with the present invention wherein an adhesive is applied to the backbone and outer surface portions of a book block adjacent to the backbone, the steps comprise the application of a non-adherent coating made up of a quick-drying liquid carrier and powdered non-adherent material over the adhesive applied to the backbone and outer surface portions, superimposing a cover having front and rear leaves and spinal portion in overlying relation to the first and last pages and backbone of the book block, respectively, and applying adhesive between the front and rear leaves of the cover and the outer surface portions of the book block adjacent to the backbone and firmly uniting the cover to the book block along the adhesive locations whereby the backbone is free to move independently of the spinal portion of the cover when the book block is opened. preferably, the coating is applied to the surface of the spinal portion of the cover facing the backbone to prevent it from adhering to the backbone when the cover is united to the book block.

A second embodiment in accordance with the present invention is a soft cover book including a book block comprised of collated pages, a cover having inner and outer surfaces and including front and rear leaves superimposed on the first and last pages of the book block and a spinal portion between the front and rear leaves in overlying relation to the backbone, the front and rear leaves being hinged to the spinal portion adjacent to the backbone. In this alternative embodiment, the non-adherent coating is disposed along the inner spinal portion of the cover, the coating again being composed of a quick-drying liquid carrier and a powdered material. After application of the coating, a laminate film layer is applied to the inside cover surface, adhering to the entire inner surface of the cover with the exception of the spinal portion containing the coating. After the laminate has been placed, an adhesive is applied to the book block backbone. The cover is then firmly united to the book block along the adhesive locations, whereby the backbone is free to move independently of the spinal portion of the cover when the book block is opened. The laminate film will be adhered to the book block backbone, while remaining unattached to the spinal portion of the cover.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
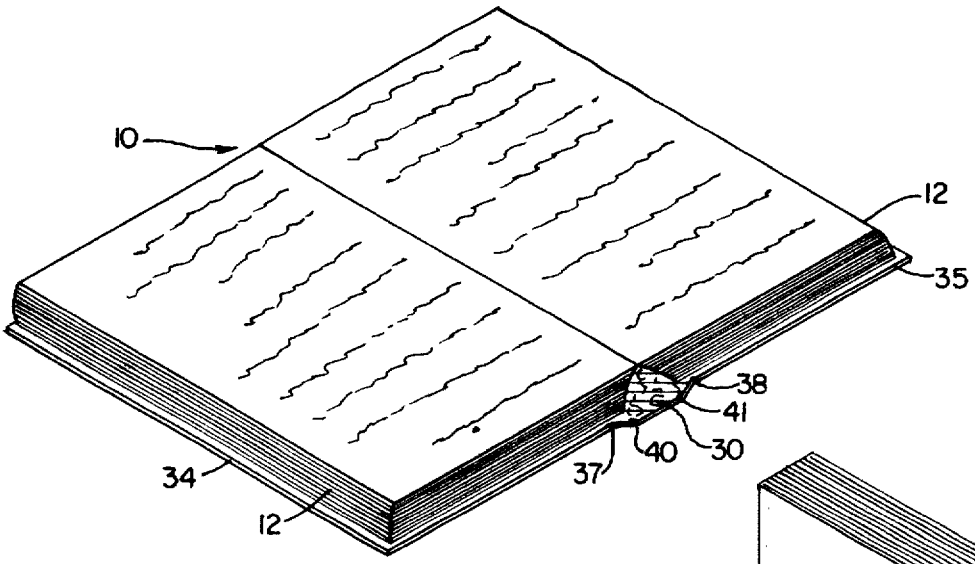
FIG. 1 is a perspective view illustrating a preferred form of soft cover book in an open position.
Figure 2:
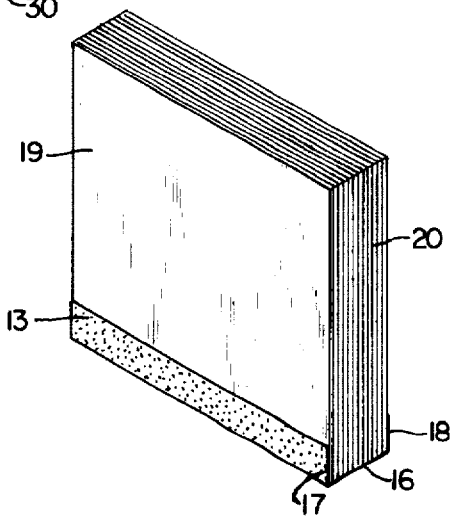
FIG. 2 is a perspective view of the preferred form of book block with a non-adherent coating applied along the outer surface portion and backbone of the book block.

Referring in more detail to the drawings, there is shown in FIGS. 1 to 4 a book block 10 which is made up of collated pages 12, the pages 12 equaling the total page content of the book. A molten synthetic resin pressure-sensitive glue or adhesive 13 is applied to the backbone or spine 16 and outer surface portions 17 and 18 of the front and rear pages 19 and 20 of the book block 10 adjacent to the backbone 16. Typically, the adhesive 13 is applied to the backbone 16 as well as to the outer surface portions 17, 18 of the book block 10 by means of glue wheels in a molten or hot condition employing a standard machine. That area of the outer surface portions covered with glue extends parallel to the backbone 16 for a width on the order of ⅛" to ¼" along the outer surface portions away from the backbone 16.

A cover 32 includes a spinal portion 30 and front and rear leaves 34 and 35 which are hinged to the spinal portion 30 along score lines 37 and 38. The cover 32 may suitably be composed of a cardboard or paper material dimensioned such that its front and rear leaves 34 and 35 correspond to the dimensions of the pages 23 of the book block 10.

An important feature of the present invention resides in the application of a coating 22 to the inner surface of the spinal portion 30 which faces the backbone 16 and adjacent surface portions along opposite side edges of the spinal portion 30 which face the outer surface portions 17 and 18 to form a non-adherent coating or film which will prevent the previously exposed, pressure-sensitive glue 13 along the backbone 16 and outer surface portions from sticking or adhering to the cover along those areas.

After the coating 22 has dried, the glue stripes or beads 24 are applied in a single line parallel to the backbone 16 to each of the front and back pages 19 and 20 just beyond the application of the glue 13 on the outer surface portions 17 and 18.

Figure 3:
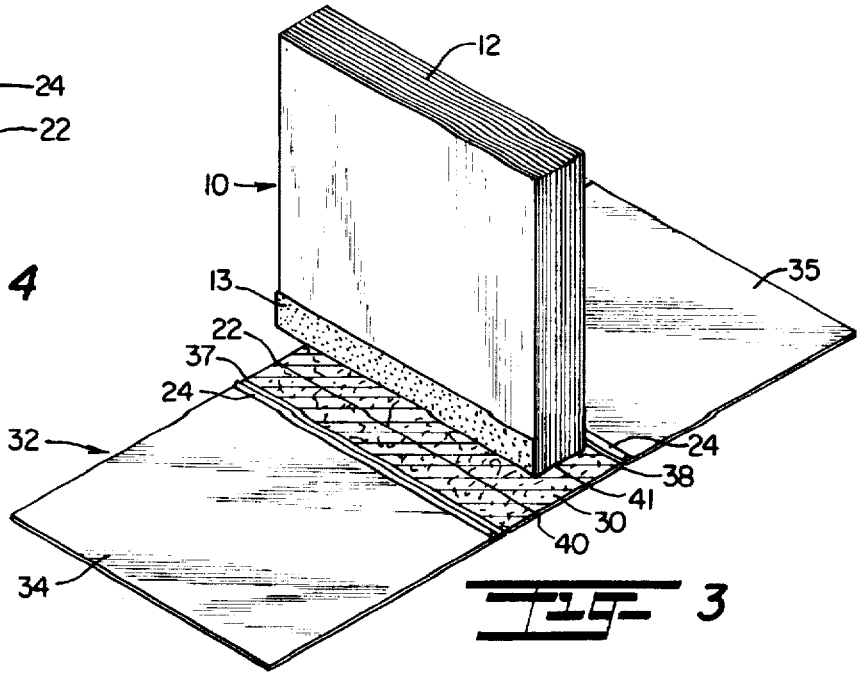
FIG. 3 is a perspective view illustrating the step of combining the cover with the book block in accordance with the present invention.

When the book block 10 is placed as illustrated in FIG. 3 with the backbone or spine 16 centered with respect to the spinal portion 30, the front and rear leaves 34 and 35 of the cover may be superimposed over front and back pages 19 and 20 of the book block and united to the book block 10 by pressing the leaves 34, 35 firmly against the glue stripes or beads 24. The location of the glue strips 24 is preferably just beyond the score lines 37, 38 of the cover, and the glue stripes are suitably composed of a synthetic resin pressure-sensitive glue corresponding to the glue 13 applied to the backbone and outer surface portions of the book block. One commercial form of glue that may be employed for the glue 13 and glue stripes 24 is Model HM-1982 manufactured and sold by H. B. Fuller of Vadnais Heights, Minn.

Depending upon the precise location of the score lines 37, 38 which define the hinging means between the spinal portion 30 and front and rear leaves 34 and 35 of the cover 32, the glue stripes 24 may be applied just outside of the score lines 37, 38 as illustrated, or may be applied directly along or just inside of the score lines. In this relation, a second pair of score lines 40 and 41 may be applied along the spinal portion 30 between the outer two score lines 37, 38 so that the spinal portion 30 will be free to more readily separate or move into a generally convex configuration as illustrated in FIG. 1 when the book is opened.

An important feature of the present invention resides in the composition of the coating 22 of a mixture of a volatile or quick-drying, liquid carrier and powdered material. In the preferred embodiment, the coating mixture is applied in solution form by brushing or spraying onto the backbone or spine 16 and outer surface portions of the book block 10 and, when the carrier dries, will leave a residue of powdered material along the spinal portion 30 which will completely coat or cover the glue 13 previously applied to the spinal portion in the initial step of the formation of the book block.

Although various volatile liquids may be employed as the carrier, a preferred form of a carrier is a rubbing alcohol, ethyl alcohol or isopropyl alcohol which is quick-drying when applied as a thin film and therefore will not tend to buckle or wrinkle the outer surface portions 17 and 18 of the pages 19 and 20 of the book block 10. The powdered material is preferably of the consistency of baking soda or cornstarch which will form a fine residue or film covering the exposed glue after the carrier has dried. The relative proportions of the powdered material to carrier may vary but preferably is made up of a major proportion of alcohol to a minor proportion of baking soda, and for example may comprise 90% by volume of alcohol to 10% by volume of powdered material. It will be appreciated that the coating 22 lends no reinforcing or support to the book block 10 but serves only as a means of preventing the glue 13 applied to the backbone 16 and portions 17 and 18 from adhering to any other surface and especially along the spinal portion 30 of the cover 32.

Figure 4:
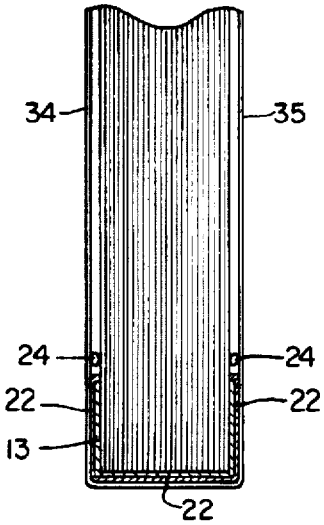
FIG. 4 is a cross-sectional view through a finished book manufactured in accordance with the present invention.

In practice, when the book has reached assembled form and is in a closed position as illustrated in FIG. 4, the spinal portion 30 will be in contact with the backbone 16 of the book block 10; however, when the book is opened, as illustrated in FIG. 1, the backbone 16 is free to move or flex upwardly away from the spinal portion 30 so that the backbone will assume a generally upwardly convex configuration. At the same time, the spinal portion 30 will tend to curve or bend downwardly as illustrated about the score lines 37, 38 and 40, 41. Thus, the pages 12 will be free to assume and maintain a generally flattened or spread condition, as illustrated in FIG. 1, as opposed to the tendency to return to a more nearly vertical attitude or disposition when the backbone is directly adhered to the more rigid spinal portion 30 of the cover.

MODIFIED FORM OF INVENTION

In a second embodiment of the present invention, the coating 22 is applied to the spinal portion 30 of the cover 32. A clear plastic containing an adhesive on one surface of a laminating film 42 is sized complementarily to the cover 32. The thickness of the film 42 is preferably on the order of 3 millimeters to 5 millimeters, although other thicknesses of film 42 may be used according to strength and flexibility desired.

The film 42 is then affixed to the inner surface of the cover 32 so that the adhesive-containing surface of the film 42 contacts the cover 32. Next, the cover 32 with the film 42 mounted thereon is run through a standard thermal laminating machine, which causes the film 42 to adhere to the inner surface of the cover 32, specifically, to the front and rear leaves 34, 35 of the cover 32, while remaining unattached to the spinal portion 30 on which the coating 22 was previously applied. preferably, a clear or transparent film 42 is used so that when adhered to the front and rear leaves 34, 35, written matter contained on the front and rear leaves 34, 35 will remain unobscured for viewing purposes.

Figure 5:
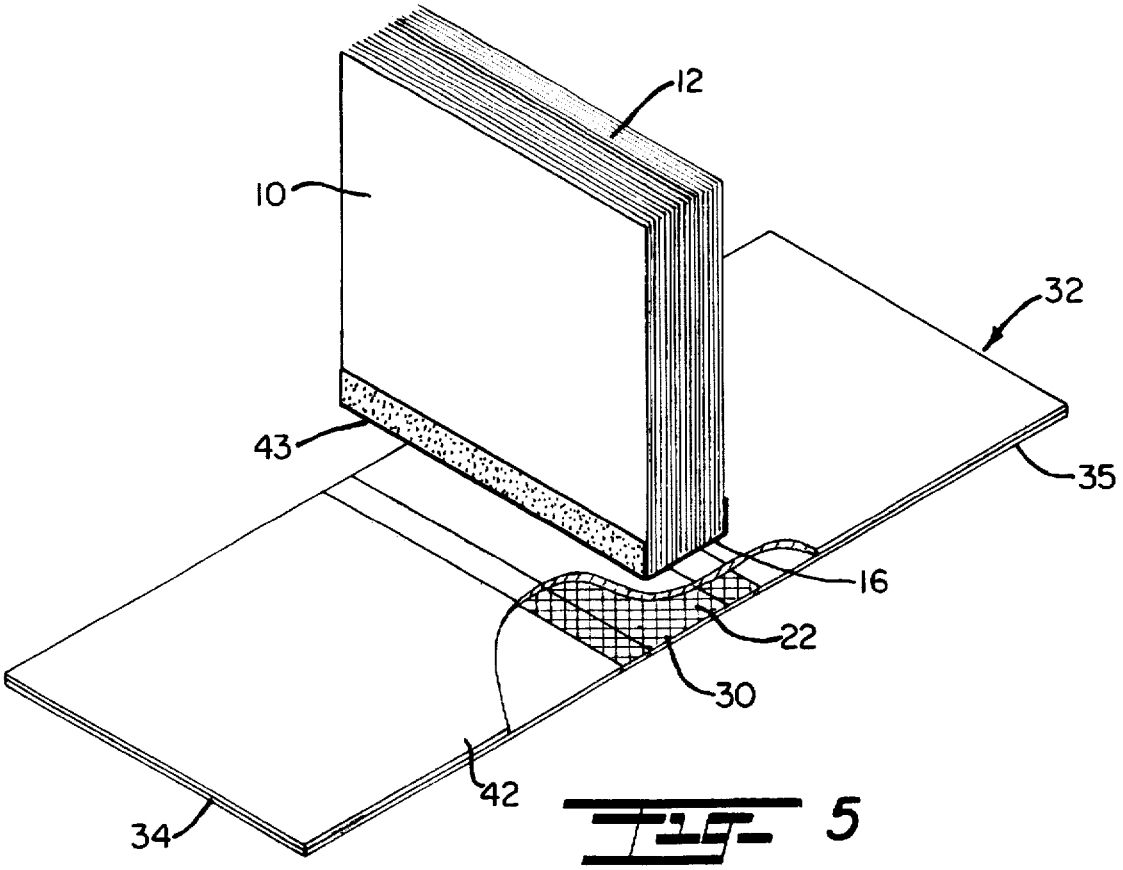
FIG. 5 is a perspective view of an alternative embodiment the present invention showing the use of a laminate film applied to the inner surface of the cover.
Figure 6:
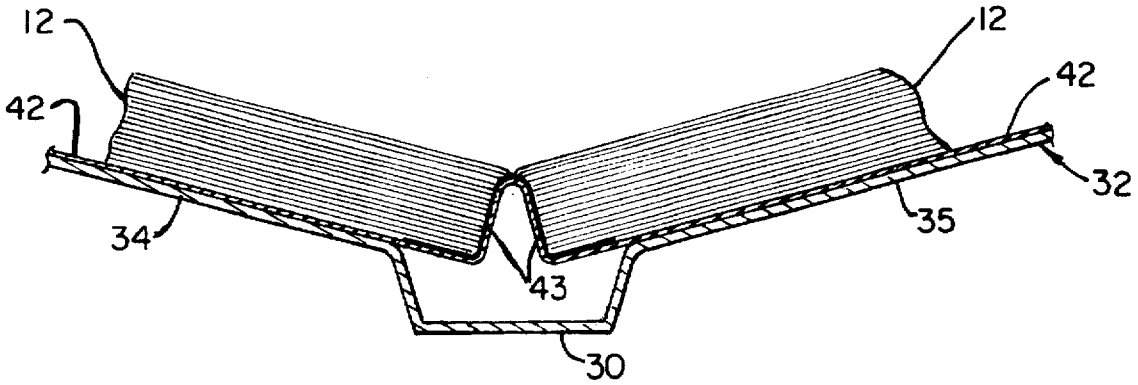
FIG. 6 is a cross-sectional view through a finished book manufactured in accordance with the alternative embodiment of the present invention.

After the laminating process described above is completed, the book block 10 may then be placed with backbone 16 centered with respect to the spinal portion 30, as best shown in FIG. 5. To adhere the book block 10 to the cover 32, a glue, preferably a hot melt glue 43, is applied to the backbone 16. The cover 32 is then united to the book block 10 by pressing the backbone 16 firmly against the spinal portion 30. As best illustrated in FIG. 6, the backbone 16 is thus adhered indirectly to the cover 32 by direct attachment to the film 42 along the spinal portion 30. The film 42, in turn, is not affixed to the spinal portion 30, which enables the backbone 16 to move independently of the spinal portion 30 when the book is opened and closed.

It is therefore to be understood that while preferred and modified forms of soft cover book construction has been herein set forth and described together with a method of making same that various modifications and changes may be made therein without departing from the spirit and scope of present invention as defined by the appended claims.

I claim:

1. In a book wherein a book block is comprised of collated pages including an adhesive applied to one edge and outer surface portions of first and last pages of said block adjacent to one edge whereby the one edge constitutes a backbone of said book, the improvement comprising:

a non-adherent coating disposed over said adhesive at least along said backbone;

a cover including front and rear leaves superimposed on said front and last pages of said book block and a spinal portion between said front and rear leaves in overlying relation to said backbone, and means hinging said front and rear leaves to said spinal portion adjacent to said backbone; and adhering means between said front and rear leaves and said outer surface portions adjacent to said backbone for adhering said cover to said block whereby said backbone is movable independently of said spinal portion when said book block is opened.

2. In a book according to claim 1, said non-adherent coating being composed of a mixture of a liquid carrier and powdered material.

3. In a book according to claim 1, wherein said non-adherent coating is composed of a volatile liquid and baking soda.

4. In a book according to claim 1, wherein said non-adherent coating is comprised of a mixture of a major proportion by volume of alcohol to a minor proportion by volume of baking soda.

5. In a book according to claim 4, wherein said mixture is comprised of approximately 90% by volume of alcohol to 10% by volume of baking soda.

6. In a book according to claim 3, wherein said volatile liquid is selected from the group consisting of isopropyl alcohol, ethyl alcohol and rubbing alcohol.

7. In a book according to claim 1, wherein said adhering means is in the form of beads of glue extending in lines along said outer surface portions adjacent to aid hinging means.

8. In a book according to claim 1, wherein said hinge means is defined by score lines extending along said front and rear leaves adjacent to said spinal portion, and said adhering means are defined by beads of glue extending in lines parallel and adjacent to said score lines.

9. In the method of manufacturing a soft cover book wherein a book block is formed by applying an adhesive to a backbone and outer surface portions of said first and last pages of said block adjacent to the backbone, the steps comprising:

applying a non-adherent coating over said adhesive at least along said backbone whereby to prevent said adhesive from adhering to another surface other than said book block;

centering said book block with respect to a cover having front and rear leaves interconnected by a spinal portion such that said backbone is aligned with said spinal portion;

applying an adhesive between said outer surface portions of said book block and inner surface portions of said front and rear leaves of said cover; and pressing said front and rear leaves of said cover against said outer surface portions of said book block whereby to firmly unite said cover and said book block with said backbone being movable independently of said spinal portion when said book block is opened and closed.

10. In the method according to claim 9, wherein the step of applying a non-adherent coating is characterized by brushing a mixture of alcohol and powdered material over said backbone and outer surface portions of said book block.

11. In the method according to claim 9, including the step of forming hinge lines between said front and rear leaves and said spinal portion of said cover and wherein said step of applying an adhesive is further characterized by applying beads of glue adjacent and parallel to said hinge lines.

12. In the method according to claim 11, wherein said stripes of glue are applied to said outer surface portions of said book block.

13. In the method according to claim 9, wherein said step of applying said non-adherent coating is further characterized by applying said coating to said backbone and said outer surface portions adjacent to said backbones.

14. In the method according to claim 9, wherein said non-adherent coating is a mixture comprised of a major proportion of alcohol and a minor proportion of baking soda.

15. In the method according to claim 14, wherein said alcohol is selected from the group consisting of rubbing alcohol, ethyl alcohol and isopropyl alcohol.

16. In a book wherein a book block is comprised of collated pages including an adhesive applied to one edge and outer surface portions of first and last pages of said block adjacent to one edge whereby the one edge constitutes a backbone of said book, the improvement comprising:

a cover having a first, inner surface and a second, outer surface and including front and rear leaves superimposed on said first and last pages of said book block, and a spinal portion between said front and rear leaves in overlying relation to said backbone;

a non-adherent coating disposed on said spinal portion;

a film disposed on said inner surface of said cover; and adhering means between said film and said backbone for adhering said cover to said block whereby said backbone is movable independently of said spinal portion when said book block is open.

17. In a book according to claim 16, said non-adherent coating being composed of a mixture of a liquid carrier and powdered material.

18. In a book according to claim 16, wherein said non-adherent coating is composed of a volatile liquid and baking soda.

19. In a book according to claim 16, wherein said non-adherent coating is comprised of a mixture of a major proportion by volume of alcohol to a minor proportion by volume of baking soda.

20. In a book according to claim 19, wherein said mixture is comprised of approximately 90% by volume of alcohol to 10% by volume of baking soda.

21. In a book according to claim 18, wherein said volatile liquid is selected from the group consisting of isopropyl alcohol, ethyl alcohol and rubbing alcohol.

22. In a book according to claim 16, wherein said adhering means is in the form of a hot melt glue extending along said backbone, and said film is a clear plastic laminating film.

23. In a book according to claim 16, wherein said film is of a thickness on the order of 3 millimeters to 5 millimeters.

24. In the method of manufacturing a soft cover book wherein a book block is formed by applying adhesive to a backbone and outer surface portions of first and last pages of said block adjacent to the backbone, the steps comprising:

applying a non-adherent coating to a spinal portion of a cover having an inner surface and an outer surface, said spinal portion interconnecting front and rear leaves of said cover;

disposing a layer over the inner surface of said cover so that said film layer is adhered to the front and rear leaves of said cover;

centering said book block with respect to the cover such that said backbone is aligned with said spinal portion;

applying an adhesive on said backbone; and pressing said backbone against said spinal portion of said cover whereby to firmly unite said cover and said book block with said backbone being movable independently of said spinal portion when said book block is opened and closed.

25. In the method according to claim 24, wherein the step of applying a non-adherent coating is characterized by brushing a mixture of alcohol and powdered material over said spinal portion of said cover.

26. In the method according to claim 24, wherein said non-adherent coating is a mixture comprised of a major proportion of alcohol and a minor proportion of baking soda.

27. In the method according to claim 26, wherein said alcohol is selected from the group consisting of rubbing alcohol, ethyl alcohol and isopropyl alcohol.

28. In the method according to claim 24, wherein said film is a clear plastic laminate film of a thickness on the order of 3 millimeters to 5 millimeters.

29. In the method according to claim 24, wherein said adhesive is a hot melt glue.

* * * * *